US006973804B2

(12) United States Patent
Horiuchi et al.

(10) Patent No.: US 6,973,804 B2
(45) Date of Patent: Dec. 13, 2005

(54) DUPLEX-TYPE HEAT EXCHANGER AND REFRIGERATION SYSTEM EQUIPPED WITH SAID HEAT EXCHANGER

(75) Inventors: Hirofumi Horiuchi, Tokyo (JP); Ryoichi Hoshino, Tokyo (JP); Noboru Ogasawara, Tokyo (JP); Takashi Tamura, Tokyo (JP); Takashi Terada, Tokyo (JP); Futoshi Watanabe, Tokyo (JP)

(73) Assignee: Showa Denko K.K., Tokyo (JP)

( * ) Notice: Subject to any disclaimer, the term of this patent is extended or adjusted under 35 U.S.C. 154(b) by 22 days.

(21) Appl. No.: 10/466,779

(22) PCT Filed: Feb. 4, 2002

(86) PCT No.: PCT/JP02/00911

§ 371 (c)(1),
(2), (4) Date: Aug. 4, 2003

(87) PCT Pub. No.: WO02/063223

PCT Pub. Date: Aug. 15, 2002

(65) Prior Publication Data

US 2004/0154331 A1 Aug. 12, 2004

Related U.S. Application Data

(60) Provisional application No. 60/302,687, filed on Jul. 5, 2001.

(30) Foreign Application Priority Data

Feb. 5, 2001 (JP) ..... 2001-027807

(51) Int. Cl.[7] ..... F25B 41/00; F25B 39/04; F25B 39/02; F28B 1/00; F28D 7/10

(52) U.S. Cl. ..... 62/513; 62/507; 62/523; 165/110; 165/140; 165/152; 165/153

(58) Field of Search ..... 62/513, 507, 523, 62/110; 165/110, 140, 152, 153

(56) References Cited

U.S. PATENT DOCUMENTS 4,821,531 A * 4/1989 Yamauchi et al. ..... 62/515
5,222,551 A * 6/1993 Hasegawa et al. ..... 165/167
5,245,843 A * 9/1993 Shimoya et al. ..... 62/515
5,568,736 A * 10/1996 Nivens ..... 62/513

(Continued)

FOREIGN PATENT DOCUMENTS

JP 134358/1988 9/1988

*Primary Examiner*—Cheryl Tyler
*Assistant Examiner*—Filip Zec
(74) *Attorney, Agent, or Firm*—Oblon, Spivak, McClelland, Maier & Neustadt, P.C.

(57) ABSTRACT

This duplex-type heat exchanger is adapted to a vapor compression type refrigeration cycle in which a condensed refrigerant is decompressed and then evaporated. This duplex-type heat exchanger is integrally equipped with a subcooler S in which the condensed refrigerant exchanges heat with the ambient air A to be subcooled and an evaporator E in which the decompressed refrigerant exchanges heat with the ambient air A to be evaporated. Heat exchange is performed between the refrigerant passing through the subcooler S and the refrigerant passing through the evaporator E, to thereby cool the refrigerant in the subcooler S and heat the refrigerant in the evaporator E. Accordingly, according to this heat exchanger, a high refrigeration effect can be obtained while avoiding the pressure rise of the refrigerant.

12 Claims, 13 Drawing Sheets

U.S. PATENT DOCUMENTS 5,632,161 A * 5/1997 Shimoya et al. ..... 62/515
5,720,341 A * 2/1998 Watanabe et al. ..... 165/135
5,960,642 A * 10/1999 Kim et al. ..... 62/513
6,220,342 B1 * 4/2001 Nishishita et al. ..... 165/153

* cited by examiner

DUPLEX-TYPE HEAT EXCHANGER AND REFRIGERATION SYSTEM EQUIPPED WITH SAID HEAT EXCHANGER

CROSS REFERENCE TO RELATED APPLICATIONS

This application is an application filed under 35 U.S.C. § 111(a) claiming the benefit pursuant to 35 U.S.C. § 119(e)(1) of the filing date of Provisional Application No. 60/302,687 filed on Jul. 5, 2001 pursuant to 35 U.S.C. § 111(b).

TECHNICAL FIELD

The present invention relates to a duplex-type heat exchanger which can be suitably used as an evaporator in a refrigeration system of an air conditioner for automobile-use, residential-use or business-use, and also relates to a refrigeration system equipped with the duplex-type heat exchanger.

BACKGROUND ART

As shown in FIG. 11, most conventional refrigeration systems for use in air conditioners for automobiles include a vapor-compression type refrigeration cycle employing a compressor 101, a condenser 102, a receiver tank 103, an expansion valve 104 and an evaporator 105. FIG. 12 illustrates a Mollier diagram showing a state of refrigerant in a refrigeration cycle in which the ordinate denotes pressure and the abscissa denotes enthalpy. In this figure, the refrigerant is in a liquid-phase state in the area located at the left side of the liquid-phase line, a vapor-liquid mixed state in the area located between the liquid-phase line and the vapor-phase line, and a gaseous-phase state in the area located at the right side of the vapor-phase line.

As shown by the solid line in this figure, the refrigerant is compressed by the compressor 101 to shift from the A point state to the B point state to thereby become high-temperature and high-pressure gaseous refrigerant, and then condensed by the condenser 102 to shift from the B point state to the point C state. The refrigerant condensed in this way is once stored in the receiver tank 103, and only the liquefied refrigerant is decompressed and expanded by the expansion valve 104 to shift from the C point state to the D point state to thereby become low-pressure and low-temperature mist-like refrigerant. Then, this refrigerant is evaporated and vaporized by exchanging heat with the ambient air in the evaporator 105 to shift from the D point state to the A point state, and turns into gaseous refrigerant. Here, the enthalpy difference from the D point state to the A point state is equivalent to the quantity of heat which acts on the air-cooling. Therefore, the larger the enthalpy difference is, the larger the refrigerating capacity becomes.

By the way, in order to enhance the refrigerating capacity in the aforementioned refrigeration cycle, a condenser has been developing based on the concept that the enthalpy difference at the time of evaporation is increased by subcooling the condensed refrigerant to the temperature lower than the temperature at the C point state by several degrees to increase the amount of heat rejection at the condensing process in which the refrigerant shifts from the B point state to the C point state.

As one of such improving techniques, a condenser with a receiver tank in which the receiver tank is placed between the condensing portion and the subcooling portion has been proposed.

As shown in FIG. 13, this proposed condenser with a receiver tank is called a subcool system condenser or the like. The condenser is provided with a multi-flow type heat-exchanger core 111 and a receiver tank 113 attached to one of the headers 112. The upstream side of the heat-exchanger core 111 constitutes a condensing portion 111C, and the downstream side thereof constitutes a subcooling portion 111S independent to the condensing portion 111C. In this condenser, the refrigerant introduced via the refrigerant inlet 111*a* is condensed by exchanging heat with the ambient air when the refrigerant passes through the condensing portion 111C, and the condensed refrigerant is introduced into the receiver tank 113 to be separated into a liquefied refrigerant and a gaseous refrigerant. Only the liquefied refrigerant is then introduced into the subcooling portion 111S to be subcooled, and then flows out of the refrigerant outlet 111*b*.

In the refrigeration cycle including this condenser, as shown by the broken line in FIG. 12, the refrigerant compressed by the compressor shifts from the A point state to the Bs point state to become high-temperature and high-pressure gaseous refrigerant, and then is cooled by the condensing portion 111C to shift from the Bs point state to the Cs1 point state to thereby become liquefied refrigerant. Furthermore, after passing through the receiver tank 113, the liquefied refrigerant is subcooled by the subcooling portion 111S to shift from the Cs1 point state to the Cs2 point state. Then, this liquefied refrigerant is decompressed and expanded by an expansion valve to shift from the Cs2 point state to the Ds point state, and turns into mist-like refrigerant. The mist-like refrigerant is then evaporated and vaporized by an evaporator to shift from the Ds point state to the A point state, and turns into vapor refrigerant.

In this refrigeration cycle, by subcooling the condensed refrigerant as shown in Cs1–Cs2, the enthalpy difference at the time of evaporation (Ds–A) becomes larger than the enthalpy difference (D–A) at the time of evaporation in the normal refrigeration cycle. Therefore, an outstanding refrigeration effect can be obtained.

The aforementioned conventional proposed condenser with a receiver tank is mounted in a limited space of an automobile like other existing condensers, and has fundamentally the same size as that of the existing condenser. However, since the conventional proposed condenser with a receiver tank uses the lower portion of the core 111 as a subcooling portion 111S which does not contribute to condensation, as compared with the existing condenser, the condensing portion 111C becomes small by the subcooling portion 111S, and therefore the condensing capacity deteriorates. Accordingly, it is necessary to increase the refrigerant pressure by a compressor and send high-temperature and high-pressure refrigerant into a condensing portion 111C so that the refrigerant can be assuredly condensed irrespective of the low condensing capacity. Consequently, in this refrigeration cycle, the refrigerant pressure increases especially in the condensing area, and as shown by the Mollier diagram in FIG. 12, in the refrigeration cycle using the conventional proposed condenser with a receiver tank, the refrigerant pressure in the condensing and subcooling area (Bs–Cs2) is high as compared with a normal refrigeration cycle. Accordingly, the load of compressor becomes large, and therefore it is required to increase the size of the compressor and enhance the performance thereof, which in turn causes increased size and weight of the refrigeration system and expensive manufacturing cost.

Furthermore, since the receiver tank 113 is integrally attached to the core 111, the receiver tank 113 is located near the condensing portion 111C to thereby interfere with the condensing portion 111C. Thus, the effective cooling area of the condensing portion 111C will decrease. Accordingly, in order to suppress the reduction of the effective cooling area, it was required to further increase the size of the condenser.

It is one object of the present invention to solve the aforementioned prior art problems and provide a duplex-type heat exchanger capable of obtaining high refrigeration performance and reducing the size and weight without increasing the refrigerant pressure.

It is another object of the present invention to provide a refrigeration system capable of obtaining high refrigeration performance and reducing the size and weight without increasing the refrigerant pressure.

DISCLOSURE OF INVENTION

According to the first aspect of the present invention, a duplex-type heat exchanger for use in a refrigeration cycle in which condensed refrigerant is decompressed and then the decompressed refrigerant is evaporated, includes a subcooler for subooling the condensed refrigerant by exchanging heat with ambient air, and an evaporator for evaporating the decompressed refrigerant by exchanging heat with ambient air, wherein heat exchange is performed between the refrigerant passing through the subcooler and the refrigerant passing through the evaporator to thereby cool the refrigerant in the subcooler and heat the refrigerant in the evaporator.

In the aforementioned duplex-type heat exchanger, since heat exchange is performed between the refrigerant in the subcooler and the refrigerant in the evaporator to thereby cool the refrigerant in the subcooler, the heat rejection amount of the refrigerant in the condensing or subcooling process can be increased. Furthermore, in case that the aforementioned heat exchanger is applied to a refrigeration cycle, it is not required to provide a subcooling portion in a condenser, and therefore the effective area of the condenser can be increased. Furthermore, a receiver tank or the like can be placed in a desired position apart from the condenser, which can avoid the interference with the condenser, resulting in efficient condensing capacity of the condenser.

In the aforementioned duplex-type heat exchanger, it is preferable to further include a subcooler side heat-transferring fin by which the refrigerant in the subcooler exchanges heat with ambient air and an evaporator side heat-transferring fin by which the refrigerant in the evaporator exchanges heat with ambient air, wherein the subcooler side heat-transferring fin is connected with the evaporator side heat-transferring fin in a continuous manner, whereby heat exchange is performed between the refrigerant in the subcooler and the refrigerant in the evaporator via the heat-transferring fin.

In this case, heat exchange between the refrigerant in the subcooler and the refrigerant in the evaporator can be efficiently performed via the heat-transferring fin.

Furthermore, in the aforementioned duplex-type heat exchanger, it is preferable that the subcooler is placed at a windward side relative to an air introduction direction and the evaporator is placed at a leeward side, and wherein heat exchange is performed between the refrigerant passing through an inside of the evaporator and air heated by the subcooler.

In this case, the refrigerant in the subcooler can fully be subcooled by the low temperature air immediately after the introduction, and the refrigerant in the evaporator can fully be heated to be evaporated by the high temperature air passed through the subcooler.

In the aforementioned duplex-type heat exchanger, it is preferable that the heat exchanger is provided with a core including a plurality of plate-shaped tubular elements laminated in its plate thickness direction thereof via the heat-transferring fin, wherein each of the tubular elements includes a subcooler side heat exchanging passage and an evaporator side heat exchanging passage independent to the subcooler side heat exchanging passage, each heat exchanging passage extending in a longitudinal direction of the tubular element, wherein the core is provided with a subcooler side inlet passage and a subcooler side outlet passage which are communicating with opposite ends of the subcooler side heat exchanging passage respectively and extending in a direction of laminating the tubular elements, wherein the core is provided with an evaporator side inlet passage and an evaporator side outlet passage which are communicating with opposite ends of the evaporator side heat exchanging passage respectively and extending in a direction of laminating the tubular elements, whereby the refrigerant flowed into the subcooler side inlet passage passes through the inlet passage and flows into each of the subcooler side heat exchanging passages, and then flows into the subcooler side outlet passage and flows out of the outlet passage, and the refrigerant flows into the evaporator side inlet passage passes through the inlet passage and flows into each of the evaporator side heat exchanging passages, and then flows into the evaporator side outlet passage and flows out of the outlet passage.

In this case, the core can be assembled simply and assuredly only by laminating the tubular elements like the conventional laminated type evaporator, etc.

It is preferable that the tubular element is provided with a continuous gap extending in a longitudinal direction of the tubular element and located between the subcooler side heat exchanging passage and the evaporator side heat exchanging passage in the tubular element, wherein the continuous gap is independent to both the heat exchanging passages, and opposite ends of the continuous gap are opened at opposite ends of the tubular element.

In this case, the refrigerant leakage due to poor brazing can be assuredly detected by the continuous gap, the unexpected communication between both the heat exchanging passages can be prevented assuredly.

Furthermore, it is preferable that the duplex-type heat exchanger further includes a decompressing tube as decompressing means for decompressing the condensed refrigerant, wherein the decompressing tube is placed in the evaporator side inlet passage.

In this case, the installation space for the decompressing means can be omitted to thereby further reduce the size of the heat exchanger.

According to the other aspect of the present invention, a refrigeration system having a refrigeration cycle, includes a compressor for compressing refrigerant, a condenser for condensing the refrigerant compressed by the compressor, a receiver tank for storing the refrigerant condensed by the condenser and providing liquefied refrigerant, a subcooler for subcooling the refrigerant provided from the receiver tank, decompressing means for decompressing the refrigerant subcooled by the subcooler, and an evaporator for evaporating the refrigerant decompressed by the decompressing means, wherein the subcooler and the evaporator are integrated to constitute a duplex-type heat exchanger in which heat exchange is performed between the refrigerant passing through the subcooler and the refrigerant passing through the evaporator to thereby cool the refrigerant in the subcooler and heat the refrigerant in the evaporator.

In this refrigeration system, since the subcooler and the evaporator are integrated to constitute a duplex-type heat exchanger in which heat exchange is performed between the refrigerant in the subcooler and the refrigerant in the evaporator to thereby cool the refrigerant in the subcooler, the heat rejection amount of the refrigerant in the condensing or subcooling process can be increased. Furthermore, since the subcooling portion is not provided to the condenser, the effective area of the condenser can be greatly increased. In addition, since the receiver tank can be placed at a desired position apart from the condenser to thereby prevent the interference with the condenser, the condensing capacity of the condenser can be fully secured.

In this refrigeration system, the aforementioned structure of the duplex-type heat exchanger can be suitably adapted. Using the heat exchanger, the aforementioned function and effects can be obtained.

Other objects and advantages of the present invention will be apparent from the following preferred embodiments.

BEST MODE FOR CARRYING OUT THE INVENTION

Figure 1:
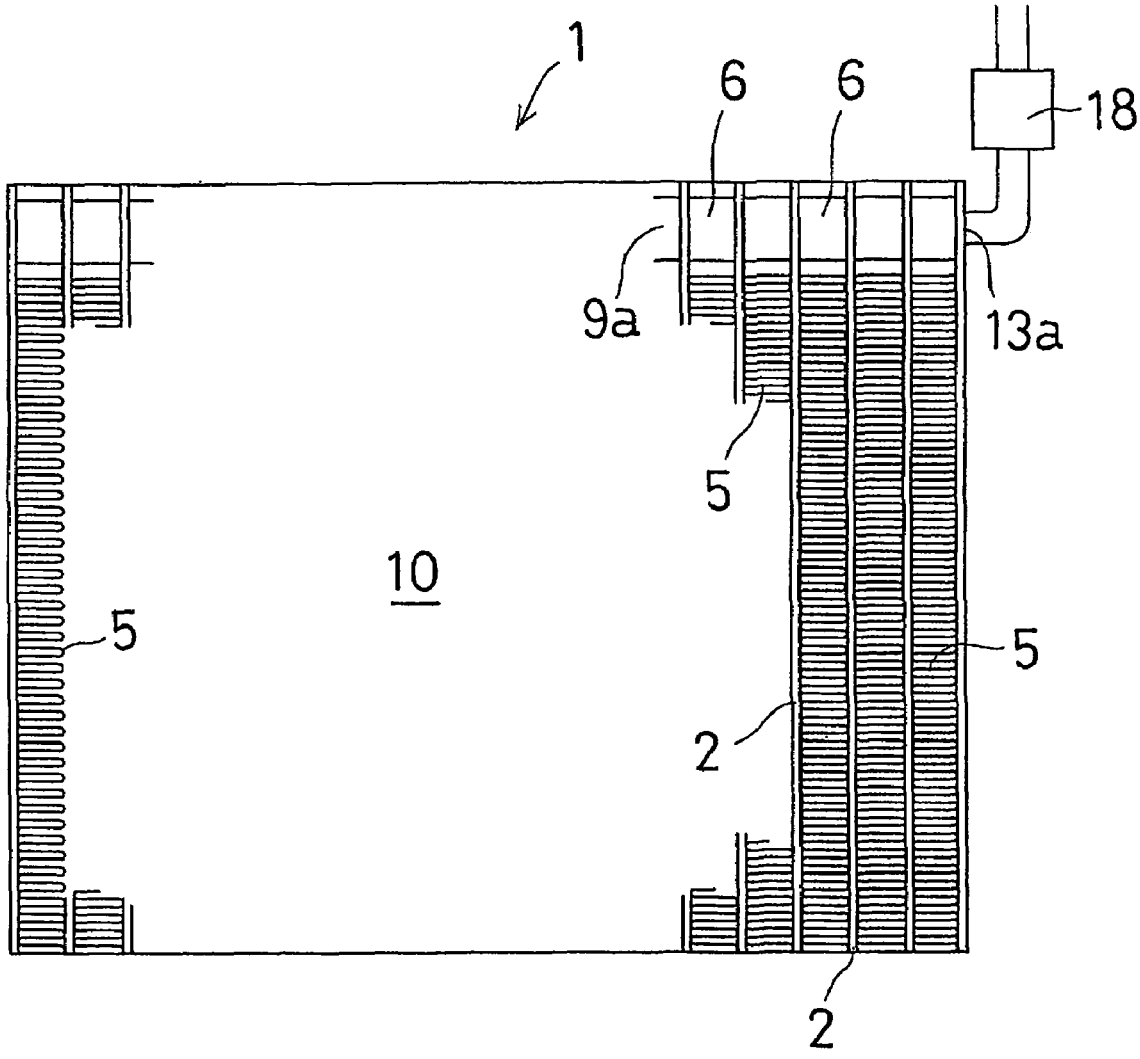
FIG. 1 is a front view showing a duplex-type heat exchanger according to an embodiment of the present invention.
Figure 2:
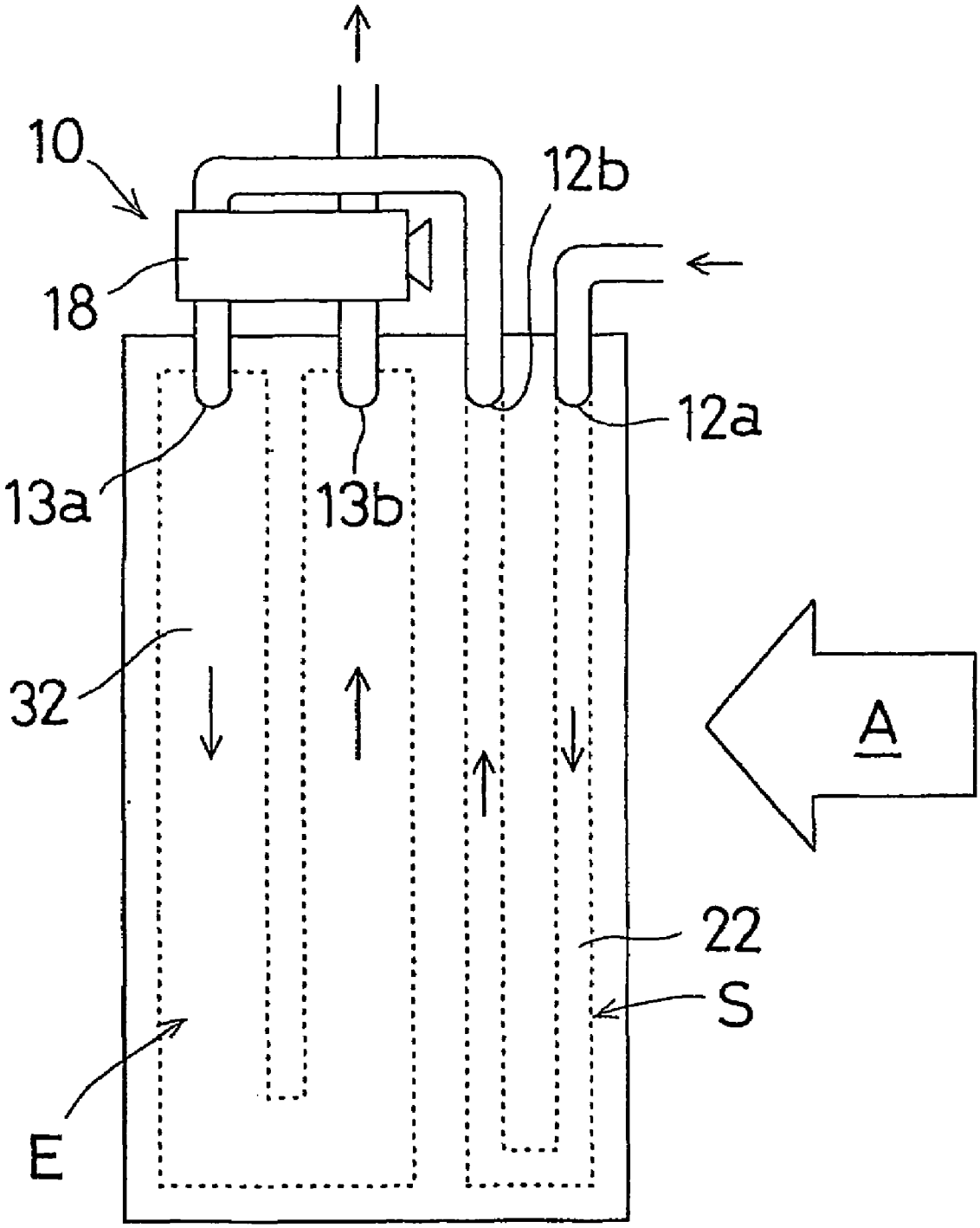
FIG. 2 is a side view showing the heat exchanger of the embodiment.
Figure 3:
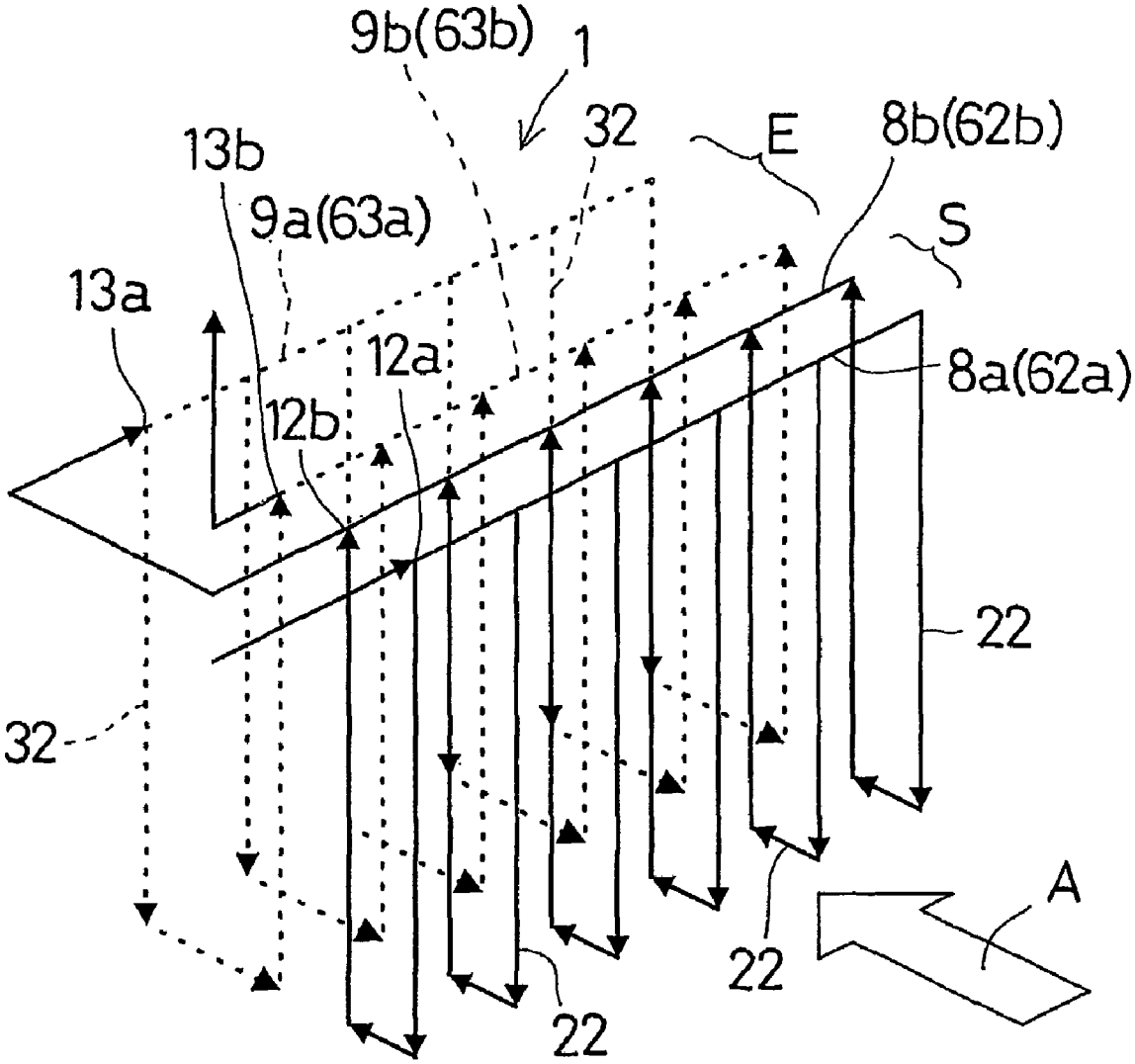
FIG. 3 illustrates a refrigerant circuit of the heat exchanger of the embodiment.

The present invention will be described in detail with reference to the attached drawings. FIGS. 1 to 7 show a duplex-type heat exchanger according to an embodiment of the present invention. As shown in these figures, this heat exchanger 1 includes plate-shaped tubular elements 2, outer fins 5 each made of a corrugated fin and connecting tubes 6. A plurality of the aforementioned tubular elements 2 are laminated in the plate thickness direction thereof with the aforementioned outer fin 5 and connecting tube 6 interposed therebetween to thereby form a core 10. The front side of the core 10 of this heat exchanger 1 constitutes a subcooler S, and the rear side thereof constitutes an evaporator E. The subcooler S and the evaporator E have an independent refrigerant circuit, respectively. In FIG. 3, the refrigerant circuit located at the subcooler side is shown by a solid line, and the refrigerant circuit located at the evaporator side is shown by a broken line.

Figure 6:
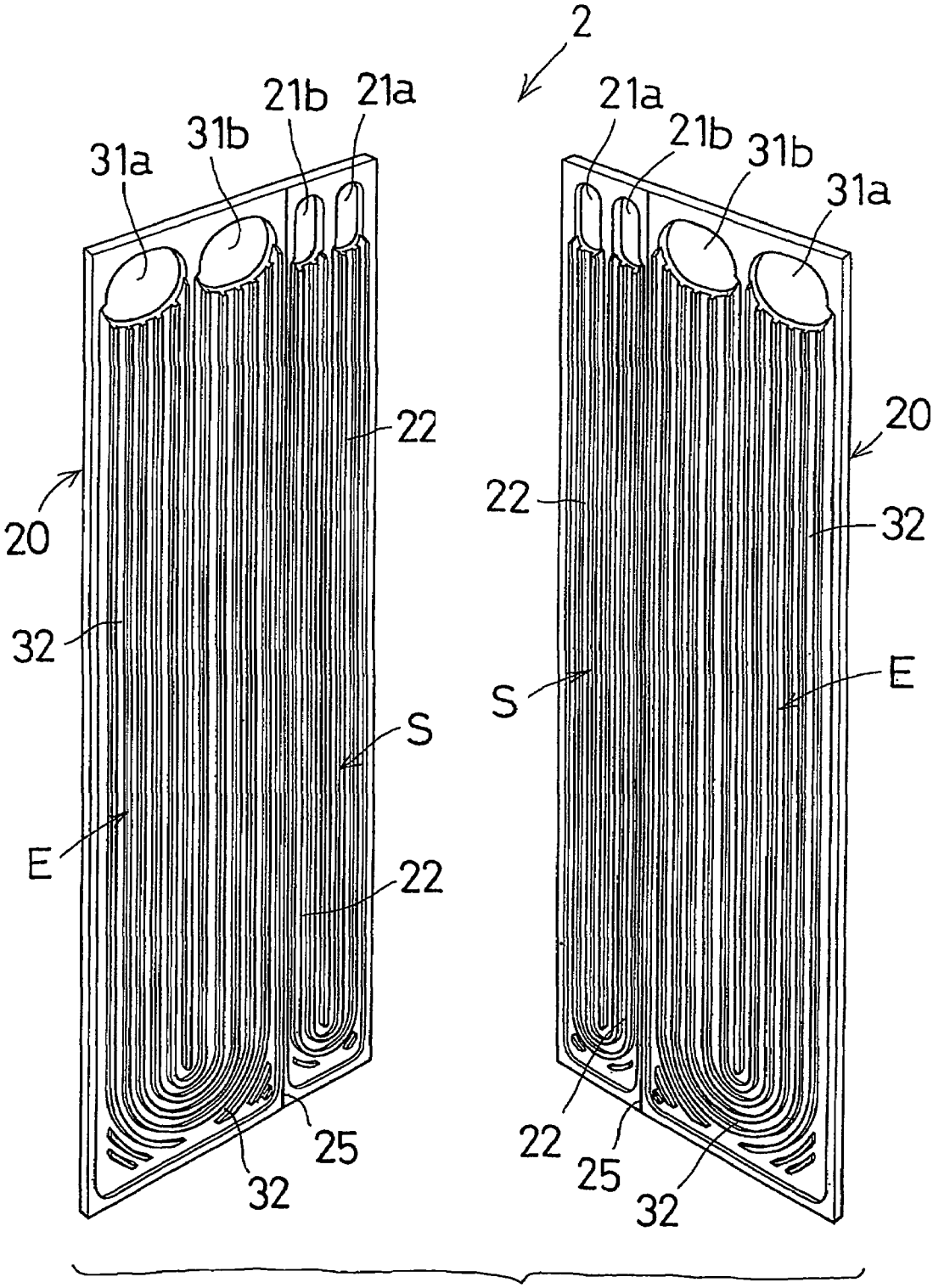
FIG. 6 is an exploded perspective view showing the tubular element of the embodiment.
Figure 7:
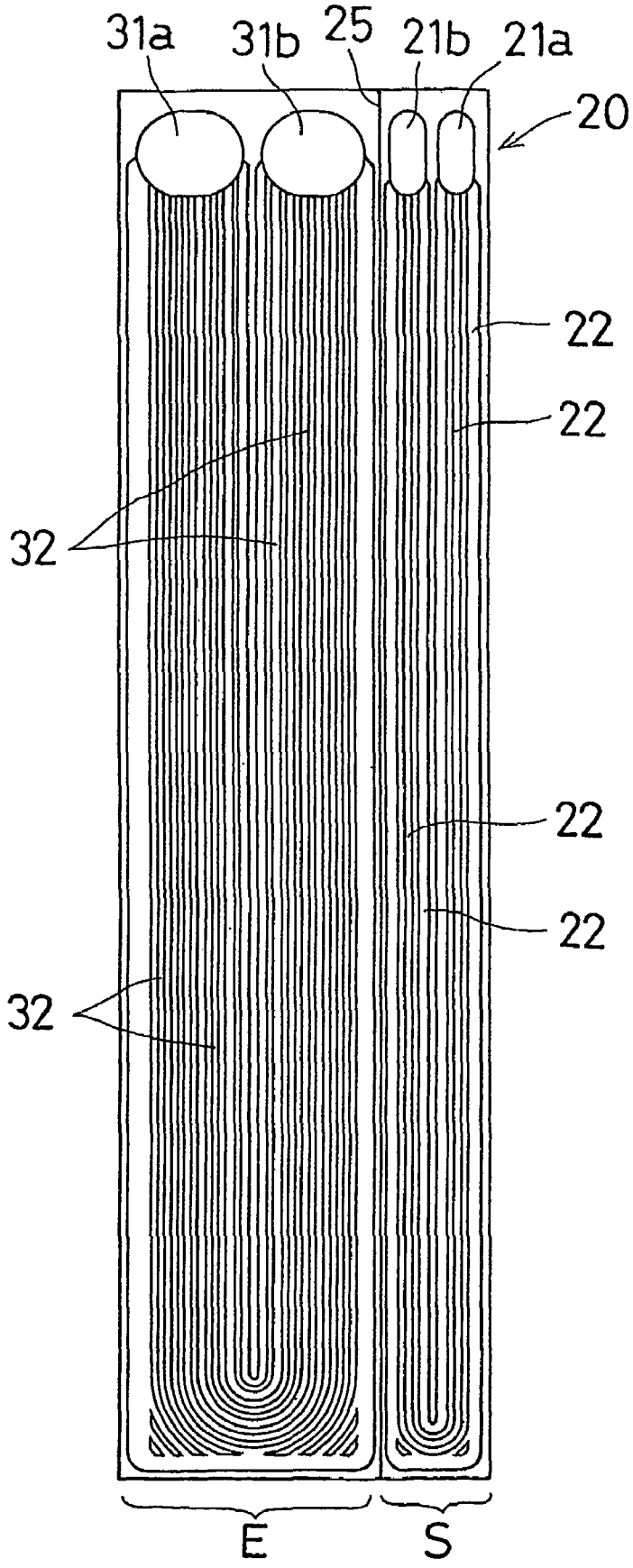
FIG. 7 is a front view showing a forming plate constituting the tubular element of the embodiment

As shown in FIG. 6, each tubular element 2 is constituted by a pair of forming plates 20 coupled in a face-to-face manner.

The forming plate 20 is a rectangular aluminum formed article obtained by pressing, rolling or cutting an aluminum brazing sheet or the like.

At the subcooler S side of the upper end portion of this forming plate 20, two small lengthwise holes 21*a*, 21*b* are formed side by side. On the other hand, at the evaporator E side of the forming plate 20, two large-diameter holes 31*a*, 31*b* are formed side by side.

Furthermore, at the subcooler S side and the evaporator E side of the inner surface of the forming plate 20, a plurality of parallel passage grooves 22, 32 are formed. One end of each passage groove 22, 32 is communicated with one of the holes 21*a*, 31*a*. Each passage groove 22, 32 extends downwardly from the holes 21*a*, 31*a*, U-turns at the lower end of the forming plate 20 and then extends upwardly. The other end of each passage groove 22, 32 is communicated with the other hole 21*b*, 31*b*.

Between the subcooler S side and the evaporator E side of the inner surface of the forming plate 20, a vertically extending groove 25 is formed. The upper and lower ends of the groove 25 are opened at the upper and lower ends of the forming plate 20, respectively.

In a state that the pair of forming plates 20 are coupled in a face-to-face manner, the corresponding passage grooves 22, 32 of the forming plates 20, 20 constitute a subcooler side heat exchanging passage 22 and an evaporator side heat exchanging passage 32. The opposite ends of the subcooler side heat exchanging passages 22 are communicated with the corresponding small holes 21*a*, 21*b*, and the opposite ends of the evaporator side heat exchanging passages 32 are communicated with the corresponding large-diameter holes 31*a*, 31*b*.

Figure 5A:
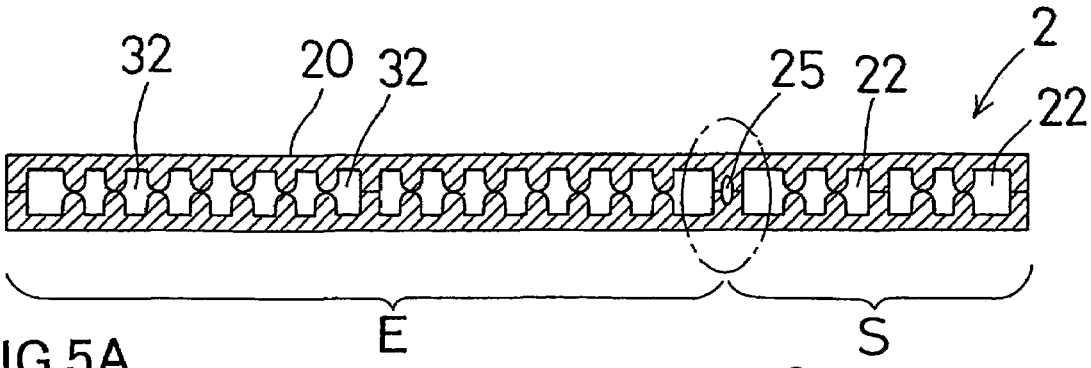
FIG. 5A is a cross-sectional view showing the tubular element of the embodiment.
Figure 5B:
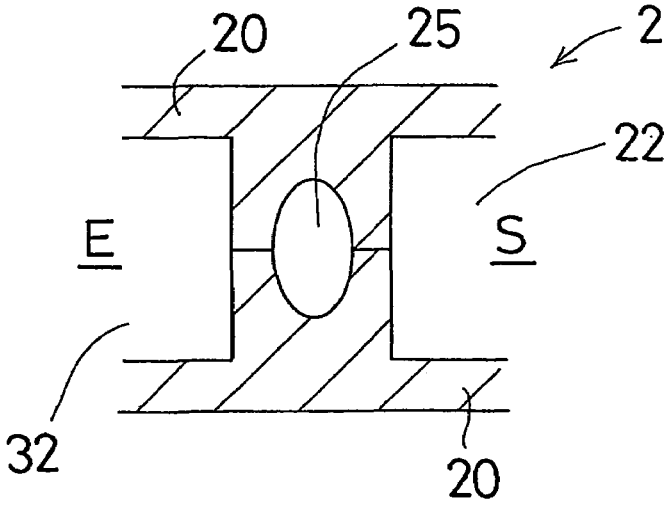
FIG. 5B is an enlarged cross-sectional view showing the portion surrounded by the alternate long and short dash line in FIG. 5A.

As shown in FIGS. 5A and 5B, the corresponding vertically extending grooves 25 between the forming plates 20, 20 form a vertically extending gap 25 whose upper and lower ends are opened at the upper and lower ends of the tubular element 2.

In this specification, in order to avoid confusion due to excessive reference numerals, the passage groove and the heat exchanging passage are allotted to the same reference numeral, and the vertically extending groove and the vertically extending aperture are allotted to the same reference numeral.

Figure 4:
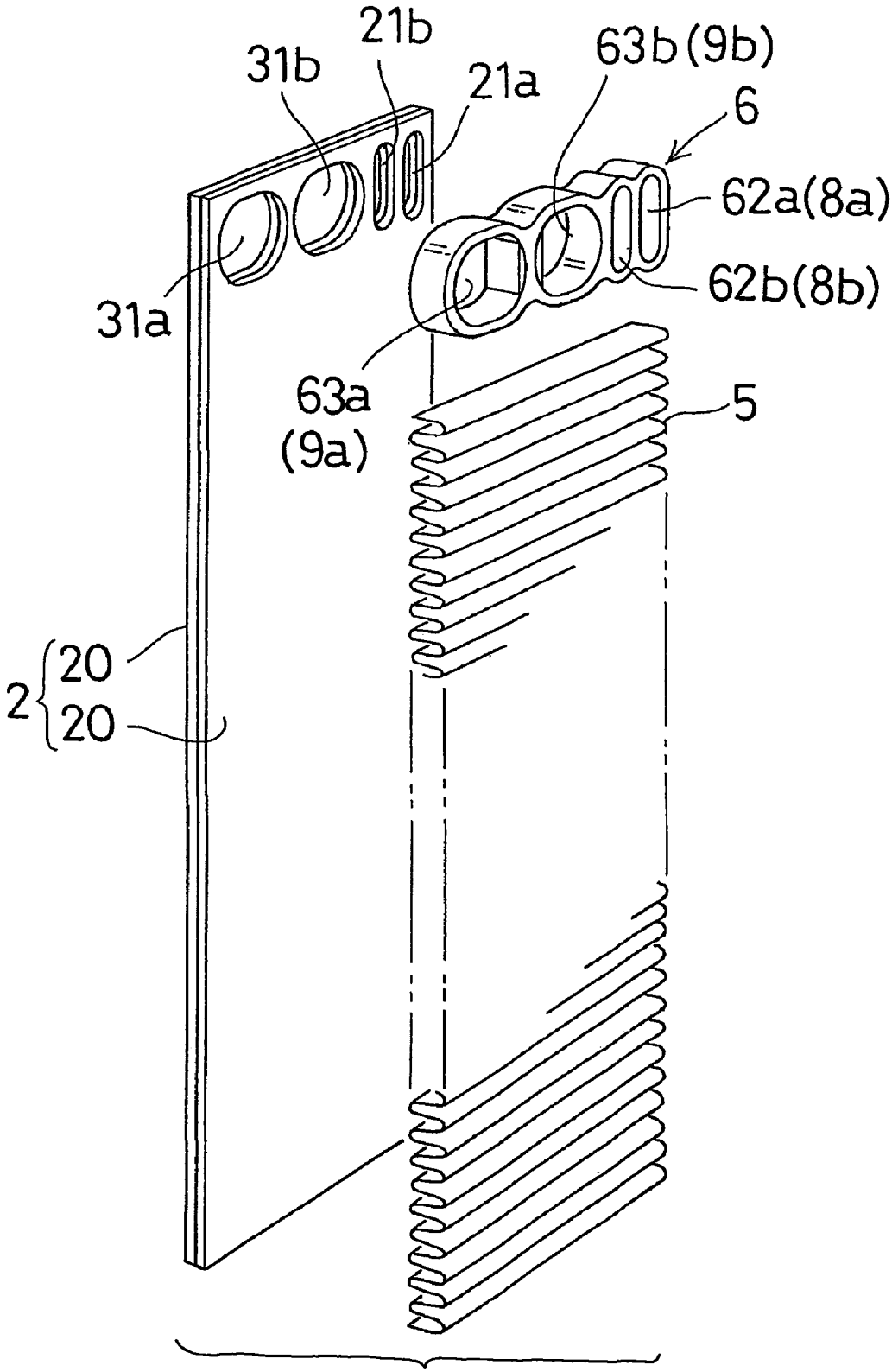
FIG. 4 is an exploded perspective view showing a tubular element and its peripheral members constituting the heat exchanger of the embodiment.

Furthermore, as shown in FIG. 4, the connecting tube 6 interposed between the upper end portions of the adjacent tubular elements 2 has a first pipe portion to a fourth pipe portion 62*a*, 62*b*, 63*a*, 63*b* corresponding to the holes 21*a*, 21*b*, 31*a*, 31*b* of the tubular element 2.

A plurality of tubular elements 2 are laminated such that the aforementioned connecting tube 6 is interposed between the upper end portions of the adjacent tubular elements 2 and that the aforementioned outer fin 5 is interposed between the remaining portions of the adjacent tubular elements 2, to thereby form the core 2.

When the core is built up, the outer fin 5 is disposed so as to extend from the front edge of the core 10 to the rear edge thereof. In other words, the outer fin 5 continuously extends between the subcooler S and the evaporator E.

In this core 10, each hole 21*a*, 21*b*, 31*a*, 31*b* of each tubular element 2 corresponds to each pipe portion 62*a*, 62*b*, 63*a*, 63*b* of the connecting tube 6. The first pipe portion 62*a* of each connecting tube 6 is arranged in series in such a way that the laminating direction of the tubular elements 2 to form a subcooler side inlet passage 8*a*. This inlet passage 8*a* is communicated with one end of the subcooler side heat exchanging passage 22 in each tubular element 2 via the hole 21*a*. Similarly, the second pipe portion to the fourth pipe portion 62*b*, 63*a*, 63*b* of each connecting tube 6 are arranged in series in the laminating direction of the tubular elements 2 to form a subcooler side outlet passage 8*b*, an evaporator side inlet passage 9*a* and an evaporator side outlet passage 9*b*, respectively. Each of these passages 8*b*, 9*a*, 9*b* is communicated with each one end of the subcooler side heat exchanging passage 22, the evaporator side heat exchanging passage 32 and the evaporator side heat exchanging passage 32 in each tubular element 2 via the corresponding hole 21*b*, 31*a*, 31*b*.

Furthermore, in the outside forming plate 20 of the tubular element 2 placed at one end of the core 10 (the left end tubular element shown in FIG. 1), the holes 21*a*, 21*b*, 31*a*, 31*b* formed at the upper portion of the forming plate 20 are closed. On the other hand, in the outside forming plate 20 of the tubular element 2 placed at the other end of the core 10, the holes 21*a*, 21*b*, 31*a*, 31*b* are opened, and constitutes a subcooler inlet port 12*a*, a subcooler outlet port 12*b*, an evaporator inlet port 13*a* and an evaporator outlet port 13*b*, respectively.

In this heat exchanger 1, the forming plate 20 of each tubular element 2 is constituted by a formed matter made of an aluminum brazing sheet, and the outer fin 5 and the connecting tube 6 are constituted by an aluminum formed article, respectively. These are provisionally assembled via a brazing material if necessary, and the provisional assembly is integrally brazed in a furnace.

In this duplex-type heat exchanger 1, as shown in FIG. 3, the refrigerant introduced via the subcooler inlet port 12*a* passes through the subcooler side inlet passage 8*a* and is evenly distributed into the subcooler side heat exchanging passages 22 of each tubular element 2. Then, the refrigerant passes through the heat exchanging passages 22 in parallel, and then is introduced into the subcooler side outlet passage 8*b*. Thereafter, the refrigerant flows out of the subcooler outlet port 12*b*.

Furthermore, the refrigerant introduced via the evaporator inlet port 13*a* passes through the evaporator side inlet passage 9*a* and is evenly distributed into the evaporator side heat exchanging passages 32 of each tubular element 2. Then, the refrigerant passes through the heat exchanging passages 32 in parallel, and then is introduced into the evaporator side outlet passage 9*b*. Thereafter, the refrigerant flows out of the evaporator outlet port 13*b*.

Figure 8:
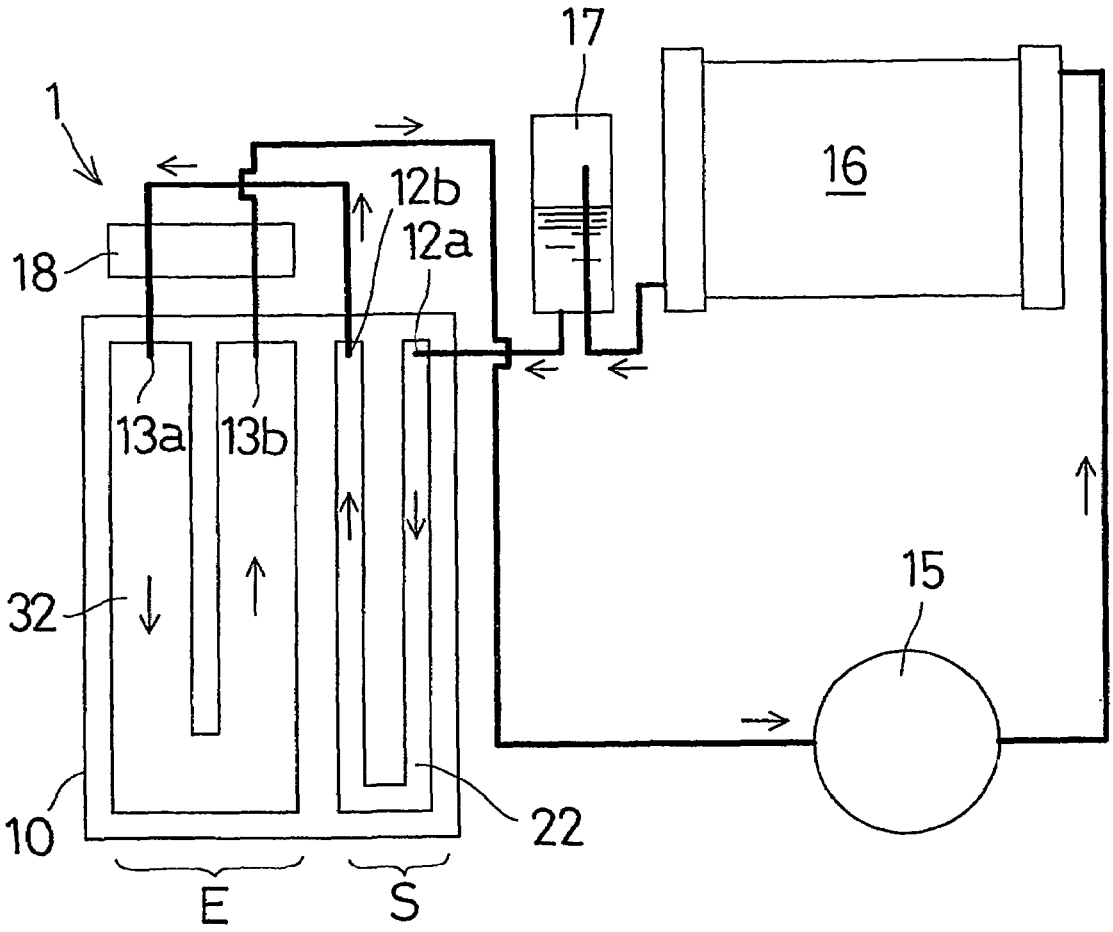
FIG. 8 is a schematic circuit configuration of a refrigeration cycle showing the case that the heat exchanger of the embodiment is applied.

As shown in FIG. 8, the aforementioned duplex-type heat exchanger 1 constitutes a refrigeration cycle together with a compressor 15, a multi-flow type condenser 16, a receiver tank 17 and an expansion valve 18. In this duplex-type heat exchanger 1, the subcooler inlet port 12*a* is connected with the outlet of the receiver tank 17, and the subcooler outlet port 12*b* is connected with the evaporator inlet port 13*a* via the expansion valve 18. Furthermore, the evaporator outlet port 13*b* is connected with the compressor 15 via the expansion valve 18. In this duplex-type heat exchanger 1, the subcooler S is arranged at the windward side relative to the incoming air A and the evaporator E is arranged at the leeward side. Thereby, the air A introduced to the heat exchanger 1 passes through the subcooler S side and then the evaporator E.

Figure 9:
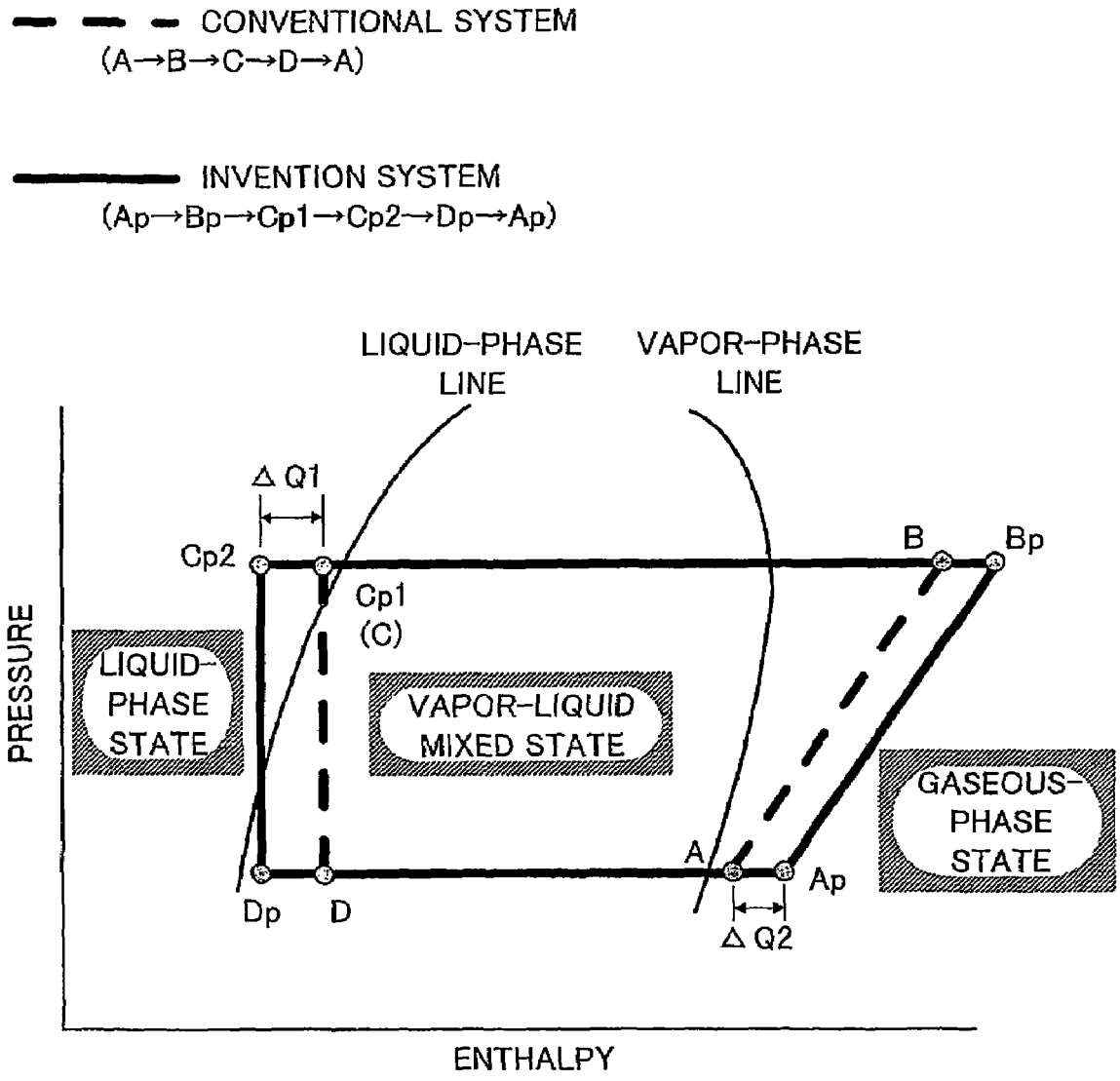
FIG. 9 is a Mollier diagram of a refrigeration cycle using the heat exchanger of the embodiment.

In this refrigeration cycle, as shown in the solid line in FIG. 9, the refrigerant is compressed by the compressor 15 to shift from the Ap point state to the Bp point state to thereby become high-temperature and high-pressure gaseous refrigerant, and subsequently condensed by the condenser 16 to shift to the Cp1 point state. The condensed refrigerant is once stored in the receiver tank 17, and only the liquefied refrigerant is extracted and introduced into the subcooler S constituting the duplex-type heat exchanger 1. In this subcooler S, the condensed refrigerant exchanges heat with the introduced air A as well as the refrigerant passing through the evaporator E via the outer fin 5 to be subcooled, to thereby shift to the Cp2 point state. Then, the subcooled refrigerant is decompressed by the expansion valve 18 to shift from the Cp2 point state to the Dp point state, to thereby become low-pressure and low-temperature mist-like refrigerant. Furthermore, this refrigerant passes through the evaporator E and exchanges heat with the introduced air A as well as the condensed refrigerant passing through the subcooler E to be evaporated, to thereby shift from the Dp point state to the Ap point state to become vapor refrigerant, and then returns to the compressor 15.

Figure 12:
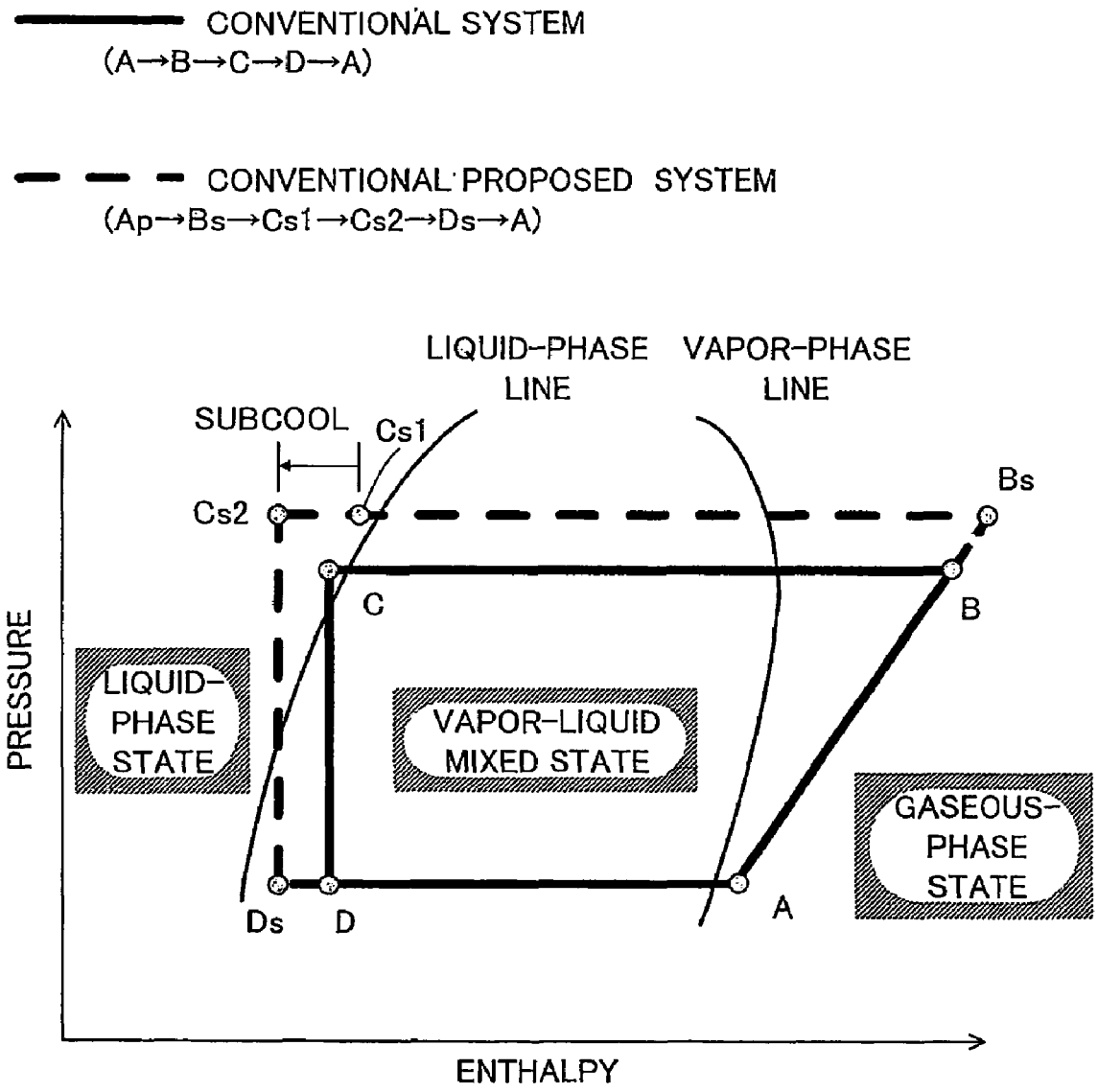
FIG. 12 is a Mollier diagram of a conventional refrigeration cycle.
Figure 13:
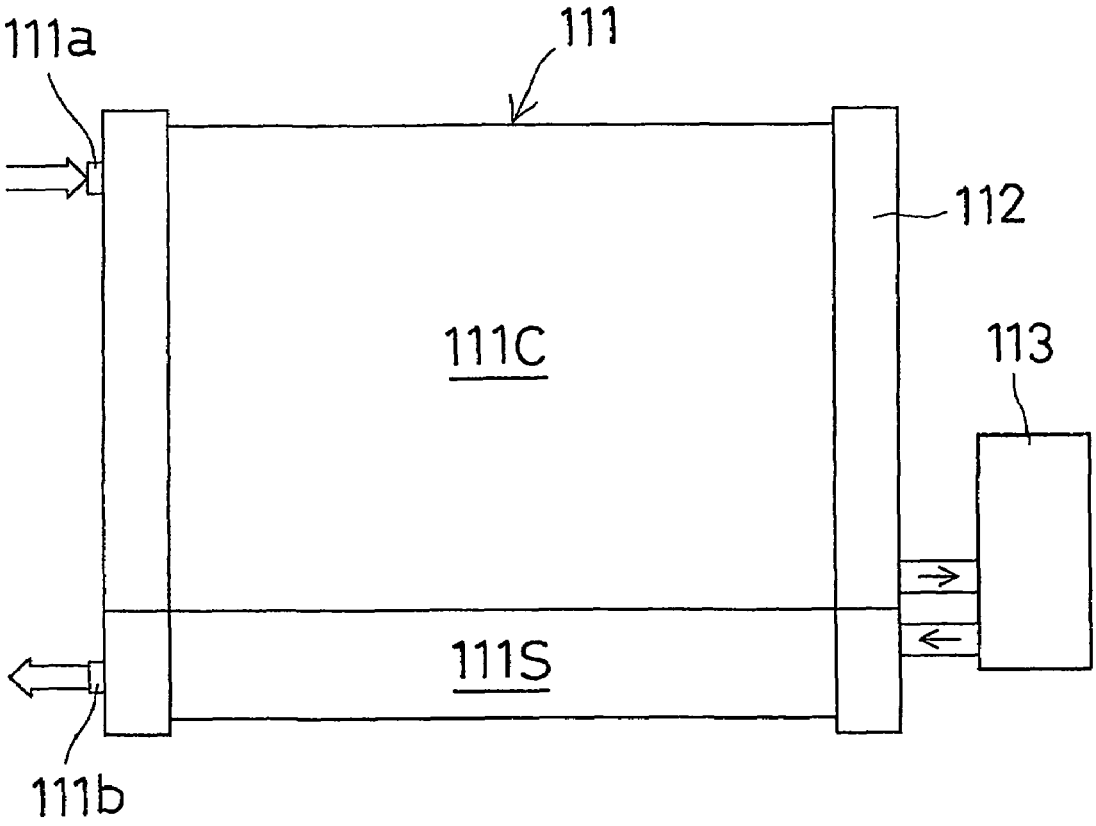
FIG. 13 is a schematic front view showing a circuit configuration of a condenser with a receiver tank according to a conventional proposal.

In the refrigeration system employing this duplex-type heat exchanger 1, the refrigerant condensed by the condenser 16 is subcooled by the subcooler S. Therefore, as shown in FIG. 9, in the condensing or subcooling process (Bp−Cp2), as compared with a normal (conventional) refrigeration cycle, the enthalpy decreases by "ΔQ1," resulting in an increased refrigeration capacity, which in turn increases the enthalpy difference at the time of evaporation. For reference, in FIG. 9, the Mollier diagram of the conventional refrigeration system is shown by a broken line (equivalent to the solid line in FIG. 12).

Furthermore, in the heat exchanger 1 of this embodiment, since the refrigerant is evaporated in the evaporator E by exchanging heat with the relatively hot air A passed through the subcooler E as well as the condensed refrigerant in the subcooler S, the enthalpy difference at the time of evaporation increases by "ΔQ2" as compared with the conventional refrigeration cycle. Accordingly, the enthalpy difference at the time of evaporation (Ap−Dp) can be further increased, which enables to obtain a sufficient refrigeration effect.

Furthermore, in the evaporator E of this embodiment, since the refrigerant exchanges heat with the high temperature air A as well as the condensed refrigerant, the refrigerant can fully be heated in the evaporating process. This enables an appropriate superheating of the refrigerant, which can effectively prevent such a default that the evaporated refrigerant returns to a compressor with liquid state because of insufficient heating.

Furthermore, in this embodiment, since the outer fin 5 continuously extends between the subcooler S and the evaporator E, heat exchange can be performed between the refrigerant in the subcooler S and the refrigerant in the evaporator E, which can further enhance the refrigeration effects.

In this embodiment, since the refrigerant flows out of the evaporator E at higher temperature as compared with a normal refrigeration cycle, the specific volume of the refrigerant becomes larger, which may cause deterioration of the circulation amount of the refrigerant. Even if taking consideration of this, however, in this embodiment, since the refrigeration effects of the refrigerant (enthalpy difference) remarkably increases as described above, the refrigeration capacity improves.

Furthermore, in the duplex-type heat exchanger 1 of this embodiment, since the evaporator E is integrally provided to the subcooler S, it is not required to provide a subcooling portion to a condenser itself like a conventional proposed refrigeration system using a heat exchanger with a receiver tank. In other words, the entire condenser can be constituted as an original condensing portion. Therefore, the heat rejection of the refrigerant can be performed efficiently, which enables to assuredly obtain enough condensing capacity. Accordingly, the rise of refrigerant pressure in the refrigeration cycle can be prevented, which in turn can decrease, for example, the load of compressor as well as the weight and the size.

Furthermore, in this embodiment, since the receiver tank 17 is provided separate from the condenser 16, the receiver tank 17 can be arranged at a desired position such as a surplus space in an engine room. Therefore, it becomes possible to utilize the engine space efficiently and prevent that the receiver tank 17 interferes with the condenser 16. From this point of view, sufficient condensing capacity can be given to the condenser, which further enhances the refrigeration capacity.

Furthermore, since the duplex-type heat exchanger 1 according to the aforementioned embodiment has the core 10 integrally provided with the evaporator E and the subcooler S, the heat exchanger can be small in size and light in weight as compared with the case that an evaporator and a subcooler are separately provided. In addition, since the subcooler side heat exchanging passage 22 and the evaporator side heat exchanging passage 32 are formed in each tubular element 2, the assembly of the heat exchanger 1 can be easily performed by simply laminating the tubular elements 2.

In cases the forming plate 20 constituting the tubular element 2 is formed by roll-press forming, etc., the passage grooves 22, 32 of the forming plate 20 can be formed more precisely, as compared with the case that the forming plate 20 is formed by bending press forming, extrusion, machining or the like. Therefore, it becomes possible to provide a high performance and small duplex-type heat exchanger with sufficient strength and improved pressure resistant.

Furthermore, in this embodiment, the vertically extending groove 25 is formed in the tubular element 2 so as to form a gap to be located between the subcooler side heat exchanging passage 22 and the evaporator side heat exchanging passage 32. Therefore, the groove 25 enables a detection of refrigerant leakage and a prevention of an unexpected communication of these heat exchanging passages 22, 23. Accordingly, the product quality can be improved.

Furthermore, in this embodiment, the subcooler S is arranged at the windward side of the introduction air A, and the evaporator E is arranged at the leeward side. Therefore, the refrigerant passing through the subcooler S is fully subcooled by the relatively low temperature air A immediately after the introduction, and the refrigerant passing through the evaporator E is fully heated by the high temperature air A passed through the subcooler S, to thereby perform efficient heat exchange.

Although the expansion valve 18 is used as decompressing means in the aforementioned embodiment, this invention is not limited only to the above. The decompressing means may be a decompressing tube, such as a capillary tube or an orifice tube.

Figure 10:
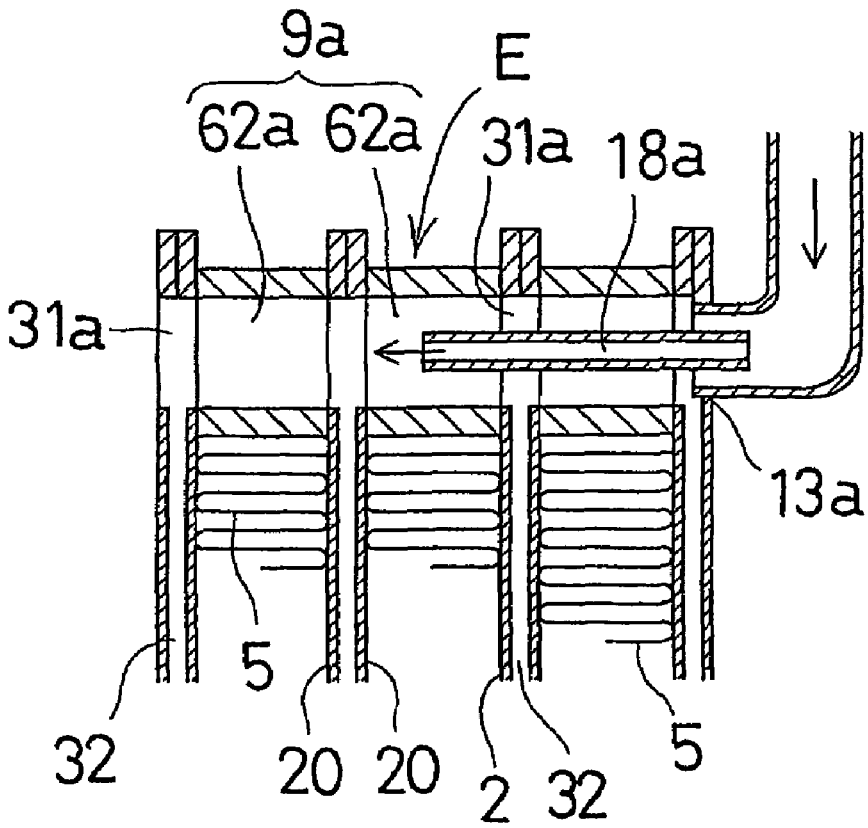
FIG. 10 is a cross-sectional view showing an evaporator inlet portion and its vicinity of the duplex-type heat exchanger according to a modification of the present invention.
Figure 11:
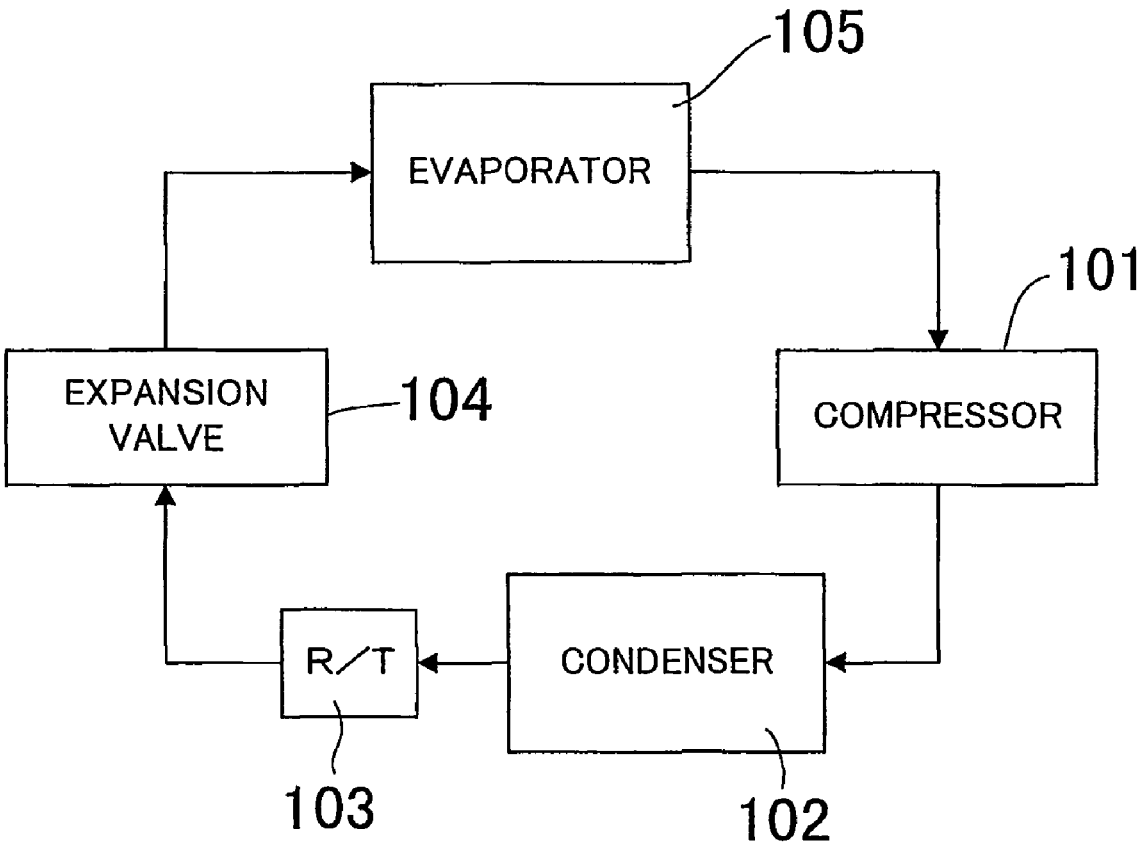
FIG. 11 is a circuit diagram showing a structure of a conventional refrigeration cycle.

For example, in case that a small pipe such as an orifice tube is used as decompressing means, as shown in FIG. 10, the orifice tube 18*a* may be installed in the evaporator inlet port 13*a* of the evaporator side inlet passage 9*a* in the evaporator 1. As mentioned above, by installing the decompressing means within the heat exchanger core 10, the installation space for decompressing means can be omitted. Thus, the size and weight of the heat exchanger can be further decreased to achieve same performance.

In the aforementioned embodiment, the plurality of subcooler side heat exchanging passages 22 of each tubular element 2 are arranged in parallel with each other, and are formed independently. However, the present invention is not limited to the above. For example, the partitioning wall located between the adjacent subcooler side heat exchanging passages 22 may have an opening so that the refrigerant can pass through each heat exchanging passage 22 evenly. Also, the partitioning wall located between the adjacent evaporator side heat exchanging passages 32 may have an opening so that the refrigerant can pass through each heat exchanging passage 32 evenly.

Furthermore, in the present invention, the subcooler side heat exchanging passage and the evaporator side heat exchanging passage 22, 32 may be constituted by, for example, a single heat exchanging passage having a large width, respectively. In cases where the heat exchanging passage is constituted by a single wide passage, an uneven-shaped inner fin may be provided in the heat exchanging passage so as to improve the heat transfer efficiency in the heat exchanging passage for the refrigerant.

Furthermore, in the aforementioned embodiment, although the laminated-type heat exchanger in which the forming plate and the connecting tube are separately formed is exemplified, the present invention is not limited to this, but may be applied to a drawn-cup type laminated heat exchanger in which a connecting tube (tank portion) is integrally formed to the forming plate by drawing processing.

As mentioned above, the aforementioned duplex-type heat exchanger is provided with a subcooler and an evaporator, and the refrigerant in the subcooler is cooled by performing heat exchange between the refrigerant in the subcooler and the refrigerant in the evaporator. Therefore, the amount of heat rejection during the condensing or subcooling process increases, and therefore the refrigeration effect can be improved. Furthermore, in any cases where the heat exchanger according to the present invention is applied to a refrigeration cycle, it is not required to provide a subcooling portion to the condenser. Therefore, the effective area of the condenser can be increased, and a receiver tank or the like can be arranged at a desired position apart from the condenser, which can avoid an interference with the condenser. Accordingly, the condensing capacity of the condenser can fully be secured, and a rise of refrigerant pressure within the refrigeration cycle can be prevented. Furthermore, it becomes possible to decrease the size and weight.

Furthermore, in case that the heat-transferring fin is provided in such a way that the fin continuously extends the subcooler and the evaporator, the heat exchange between the refrigerant in the subcooler and the refrigerant in the evaporator can be performed efficiently via the heat-transferring fin, whereby the aforementioned effect can be obtained more assuredly.

Furthermore, in case that the subcooler is arranged to a windward side and the evaporator is arranged to a leeward side, the refrigerant in the subcooler can fully be subcooled by relatively low temperature air immediately after the introduction, and the refrigerant in the evaporator can fully be heated and therefore evaporated assuredly by the high-temperature air passed through the subcooler. Accordingly, there is an advantage that heat exchange can be performed much more efficiently.

Furthermore, in case that a plurality of plate-shaped tubular elements each having the subcooler side heat exchanging passage and the evaporator side heat exchanging passage which are independent with each other are laminated to form a core, like the conventional laminated type evaporator, etc., the core can be certainly formed by simply laminating tubular elements, and therefore the assembly can be performed easily.

Furthermore, in case that the vertically extending aperture is formed between the subcooler side heat exchanging passage and the evaporator side heat exchanging passage of the tubular element, the gap enables a detection of refrigerant leakage and a prevention of an unexpected communication of these heat exchanging passages. Accordingly, the product quality can be improved.

Furthermore, in case that an orifice tube as decompressing means is incorporated in a core, since the installation space for decompressing means can be omitted, there is an advantage that a miniaturization can be attained.

This application claims priority to Japanese Patent Application No. 2001-27807 filed on Feb. 5, 2001, the disclosure of which is incorporated by reference in its entirety.

The terms and descriptions in this specification are used only for explanatory purposes and the present invention is not limited to these terms and descriptions. It should be appreciated that there are many modifications and substitutions without departing from the spirit and the scope of the present invention which is defined by the appended claims. A present invention permits any design-change, unless it deviates from the soul, if it is within the limits by which the claim was performed.

INDUSTRIAL APPLICABILITY

The duplex-type heat exchanger and the refrigeration system according to the present invention can be suitably used in a refrigeration system of air conditioners for not only automobile-use but also residential-use or business-use.

What is claimed is:

1. A duplex-type heat exchanger for use in a single refrigeration cycle in which condensed refrigerant is decompressed and then the decompressed refrigerant is evaporated, said duplex-type heat exchanger comprising:

a subcooler configured to subcool the condensed refrigerant by exchanging heat with ambient air;

an evaporator configured to evaporate the decompressed refrigerant by exchanging heat with ambient air; and a decompressing device provided between the subcooler and the evaporator and configured to decompress the condensed refrigerant, wherein either the subcooler or the evaporator is positioned along an air flowing direction at a windward side relative to either the evaporator or the subcooler, respectively, and the subcooler and the evaporator at least partially overlap each other along the air flowing direction, and wherein heat exchange is performed between the refrigerant passing through said subcooler and the refrigerant passing through said evaporator to thereby cool the refrigerant in said subcooler and heat the refrigerant in said evaporator.

2. The duplex-type heat exchanger as recited in claim 1, further comprising a subcooler side heat-transferring fin by which the refrigerant in said subcooler exchanges heat with ambient air, and an evaporator side heat-transferring fin by which the refrigerant in said evaporator exchanges heat with ambient air, wherein said subcooler side heat-transferring fin is connected with said evaporator side heat-transferring fin in a continuous manner, whereby heat exchange is performed between the refrigerant in said subcooler and the refrigerant in said evaporator via said heat-transferring fins.

3. The duplex-type heat exchanger as recited in claim 1, wherein said subcooler is placed at a windward side relative to an air introduction direction and said evaporator is placed at a leeward side, and wherein heat exchange is performed between the refrigerant passing through an inside of said evaporator and air heated by said subcooler.

4. The duplex-type heat exchanger as recited in claim 1, wherein said heat exchanger is provided with a core including a plurality of plate-shaped tubular elements laminated in its plate thickness direction thereof, wherein each of said tubular elements includes a subcooler side heat exchanging passage and an evaporator side heat exchanging passage independent to said subcooler side heat exchanging passage, each heat exchanging passage extending in a longitudinal direction of said tubular element, wherein said core is provided with a subcooler side inlet passage and a subcooler side outlet passage which are communicating with opposite ends of said subcooler side heat exchanging passage respectively and extending in a direction of laminating said tubular elements, wherein said core is provided with an evaporator side inlet passage and an evaporator side outlet passage which are communicating with opposite ends of said evaporator side heat exchanging passage respectively and extending in a direction of laminating said tubular elements, whereby the refrigerant flowed into said subcooler side inlet passage passes through said inlet passage and flows into each of said subcooler side heat exchanging passages, and then flows into said subcooler side outlet passage and flows out of said outlet passage, and the refrigerant that flows into said evaporator side inlet passage passes through said inlet passage and flows into each of said evaporator side heat exchanging passages, and then flows into said evaporator side outlet passage and flows out of said outlet passage.

5. The duplex-type heat exchanger as recited in claim 4, wherein said tubular element is provided with a continuous gap extending in a longitudinal direction of said tubular element and located between said subcooler side heat exchanging passage and said evaporator side heat exchanging passage in said tubular element, said continuous gap being independent to both said heat exchanging passages, and opposite ends of said continuous gap being opened at opposite ends of said tubular element.

6. The duplex-type heat exchanger as recited in claim 4, further comprising a decompressing tube as the decompressing device, wherein said decompressing tube is placed in said evaporator side inlet passage.

7. A refrigeration system having a single refrigeration cycle, comprising:

a compressor configured to compress refrigerant;

a condenser configured to condense the refrigerant compressed by said compressor;

a receiver tank configured to store the refrigerant condensed by said condenser and provide liquefied refrigerant;

a subcooler configured to subcool the refrigerant provided from said receiver tank;

a decompressing device configured to decompress the refrigerant subcooled by said subcooler; and an evaporator configured to evaporate the refrigerant decompressed by said decompressing device, wherein said subcooler and said evaporator are integrated to constitute a duplex-type heat exchanger in which either the subcooler or the evaporator is positioned along an air flowing direction at a windward side relative to either the evaporator or the subcooler, respectively, and the subcooler and the evaporator at least partially overlap each other along the air flowing direction, and in which heat exchange is performed between the refrigerant passing through said subcooler and the refrigerant passing through said evaporator to thereby cool the refrigerant in said subcooler and heat the refrigerant in said evaporator.

8. The refrigeration system as recited in claim 7, wherein said duplex-type heat exchanger is equipped with a heat-transferring fin continuously extending said subcooler and said evaporator, wherein heat exchange is performed between the refrigerant in said subcooler and the refrigerant in said evaporator via said heat-transferring fin.

9. The refrigeration system as recited in claim 7, wherein said subcooler is placed at a windward side relative to an air introduction direction and said evaporator is placed at a leeward side, and wherein heat exchange is performed between air heated by said subcooler and the refrigerant passing through an inside of said evaporator.

10. The refrigeration system as recited in claim 7, wherein said heat exchanger is provided with a core including a plurality of plate-shaped tubular elements laminated in its plate thickness direction thereof, wherein each of said tubular elements includes a subcooler side heat exchanging passage and an evaporator side heat exchanging passage independent to said subcooler side heat exchanging passage, each heat exchanging passage extending in a longitudinal direction of said tubular element, wherein said core is provided with a subcooler side inlet passage and a subcooler side outlet passage which are communicating with opposite ends of said subcooler side heat exchanging passage respectively and extending in a direction of laminating said tubular elements, wherein said core is provided with an evaporator side inlet passage and an evaporator side outlet passage which are communicating with opposite ends of said evaporator side heat exchanging passage respectively and extending in a direction of laminating said tubular elements, whereby the refrigerant flowed into said subcooler side inlet passage passes through said inlet passage and flows into each of said subcooler side heat exchanging passages, and then flows into said subcooler side outlet passage and flows out of said outlet passage, and the refrigerant that flows into said evaporator side inlet passage passes through said inlet passage and flows into each of said evaporator side heat exchanging passages, and then flows into said evaporator side outlet passage and flows out of said outlet passage.

11. The refrigeration system as recited in claim 10, wherein said tubular element is provided with a continuous gap extending in a longitudinal direction of said tubular element and located between said subcooler side heat exchanging passage and said evaporator side heat exchanging passage in said tubular element, said continuous gap being independent to both said heat exchanging passages, and opposite ends of said continuous gap being opened at opposite ends of said tubular element.

12. The refrigeration system as recited in claim 10, further comprising a decompressing tube as the decompressing device, wherein said decompressing tube is placed in said evaporator side inlet passage.

* * * * *